United States Patent [19]

Pantzar

[11] 4,071,953

[45] Feb. 7, 1978

[54] CHAIN SAW GUIDE BAR

[75] Inventor: Glenn Göran Egon Pantzar, Arsunda, Sweden

[73] Assignee: Sandvik Aktiebolaget, Sandviken, Sweden

[21] Appl. No.: 763,016

[22] Filed: Jan. 27, 1977

[30] Foreign Application Priority Data

Jan. 29, 1976 Sweden ..... 7600921

[51] Int. Cl.[2] ..... B27B 17/04

[52] U.S. Cl. ..... 30/384

[58] Field of Search ..... 30/381–387; 83/820; 184/15 R

[56] References Cited

U.S. PATENT DOCUMENTS

| | | | |
|---|---|---|---|
| 3,878,607 | 4/1975 | Ehlen et al. | 30/387 |
| 3,967,378 | 7/1976 | Arff et al. | 30/383 |

*Primary Examiner*—Robert C. Watson

*Attorney, Agent, or Firm*—Burns, Doane, Swecker & Mathis

[57] ABSTRACT

In a chain saw guide bar which at its free end has a saw chain-supporting sprocket wheel journalled on a hub and surrounded by side plates of the guide bar, the side plates are embossed (shaped) in three concentric zones having progressive embossing depths providing, between the side plate and the sprocket wheel, a gap which progressively increases in width — either step-by-step or continuously — with the radial distance from the center of the sprocket wheel.

10 Claims, 5 Drawing Figures

CHAIN SAW GUIDE BAR

This invention relates to a chain saw structure, and is concerned with the provision of a chain saw guide bar which at its free end has a sprocket wheel surrounded by the side plates of the guide bar.

In a light chain saw with limited engine capacity it is very important to reduce the frictional resistance in the passage around the nose end of the guide bar. In guide bars with a sprocket wheel surrounded by side plates the frictional resistance partly can be reduced by choosing suitable thickness of the sprocket wheel and suitable width of the rollers of the roller-bearing in relation to the gaps between the side plates, and partly by choosing a suitable form of the bearing so that satisfactory lubrication of the bearing is made possible.

In several known constructions the inner side of the side plates has a plane surface and the sprocket wheel of uniform thickness is thinner than the width of the rollers of the bearing, which rollers are narrower than the hub. Drawbacks with this construction are partly that dirt particles easily reach the bearing as the gap between sprocket wheel and side plate is open to the bearing itself, and partly that dirt particles are easily packed between the hub and side plate, whereby the end parts of the rollers can be overloaded.

To protect them against overload, the end parts of the rollers used to be bevelled. This, however, is expensive to make and, moreover, it reduces the bearing resistance of the rollers owing to the fact that the bearing width of the rollers becomes smaller.

To avoid dirt particles between hub and side plates it has been suggested to make impressions on the side plates right towards the rollers of the bearing. This solution does not reduce the bearing resistance but it is comparatively expensive. Moreover, difficulties arise in exchanging the sprocket wheel, owing to the fact that the rollers of the bearing can be laterally displaced and catch hold of the impressions making the withdrawal of sprocket wheel with bearing impossible to do, so that the complete nose section including side plates must be exchanged.

U.S. Pat. No. 3,878,607 discloses a sprocket wheel construction wherein the guiding of the sprocket wheel is effected by the contact of the side plates against the peripheral parts of the sprocket wheel. This structure is characterized by great frictional resistance, since the frictional resistance increases with the peripheral speed, which latter, in turn, increases with the distance from the center of the sprocket wheel. The mentioned construction is also impaired by another drawback, to wit, the gap between side plate and sprocket wheel is enlarged inside the mentioned guide. Therefore, dirt particles can easily be forced into the bearing of the wheel, thereby increasing the risk of damage to the bearing.

An object of the present invention is to provide a chain saw guide bar with a nose section which gives reliable working conditions to the bearing; very low frictional resistance at the nose section of the guide bar, yet good guidance of the sprocket wheel. Moreover, the production expenses of the guide bar will be low.

Other objects and advantages of the invention will become apparent from a study of the following specification when considered in conjunction with the accompanying drawing, in which.

In the figures the width of the gaps has been magnified in order to illustrate the invention better.

Figure 1:
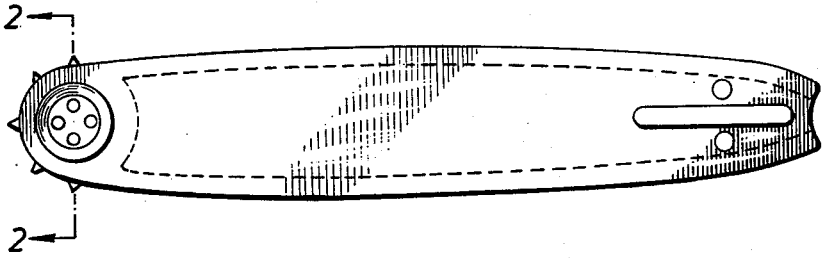
FIG. 1 is a side view of a guide bar according to the invention.
Figure 2:
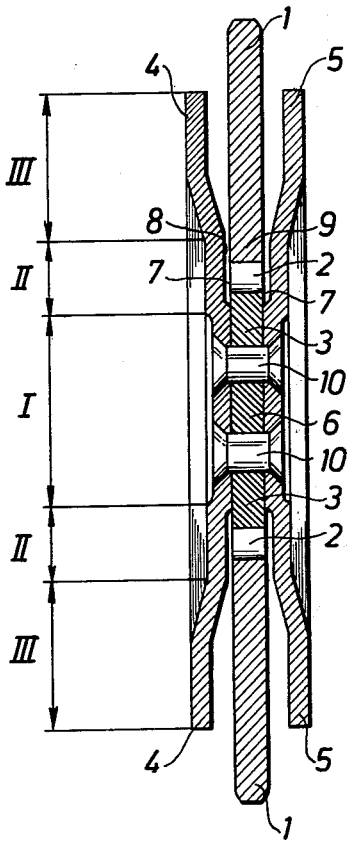
FIG. 2 is a sectional view taken along line 2—2 of FIG. 1.

Referring now to FIG. 1, there is shown a sprocket wheel 1 which is rotatably journalled on a hub 3 by a roller bearing 2. Side plates 4, 5 surround the sprocket wheel 1 and are fastened to the hub 3 by rivets 10.

According to the invention, the hub, the rollers of the bearing and the sprocket wheel are made with the same thickness and without bevels. Hub and sprocket wheel can be punched out of the same material in one operation. Due to this fact the production expense can be reduced. The side plates surrounding the sprocket wheel can be formed by embossing of concentric zones in that way the depth of the embossing increases step by step and/or continuously with the radial distance from the center 6 of the sprocket wheel.

The innermost zone I shall be plane and lie close to the hub and have a diameter being less than that of the hub from 0.2 to 2.0 mm. Due to this fact a space is formed radially inside the bearing which space serves as a reservoir for the lubricant and can receive dirt particles without risking the function of the bearing.

The second zone (denominated II) shall also be plane and extend from the edge of the innermost zone to a diameter exceeding the inner diameter of the sprocket wheel with 1.0 to 8.0 mm. The peripheral part 8 of the second zone forms a sealing- and guiding surface for the sprocket wheel. The depth of embossing, i.e. the gap between the side plate and sprocket wheel, shall be 0.03 to 0.12 mm. Due to this fact the bearing is protected against big dirt particles and as the sealing- and guiding surface acts on a small inner part 9 of the sprocket wheel, where the peripheral speed is low relatively speaking, the frictional resistance and thereby the loss of the engine effect will become very low. As has been memtioned above, the space in the gap between zone II and the sprocket wheel can serve as a reservoir for the lubricant. Owing to this there can be secured a good lubrication of the bearing.

Figure 3:
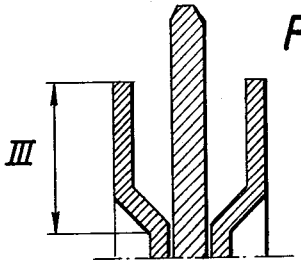
FIGS. 3–5 are different embodiments of the side plates at zone III.
Figure 4:
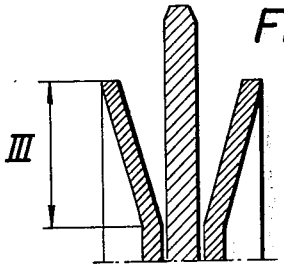
Figure 5:
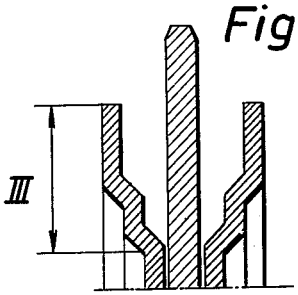

The third zone (III) extends from the outer edge of the second zone to the outer contour of the side plates. Within this third zone the gap between the side plate and the sprocket wheel shall increase outwards in one or several steps separated by one or several plane surfaces; or, step-by-step continuously in the form of tapered surfaces. In this outermost zone, the gap shall be greatest at the outer contour of side plate and shall have a width of between 0.07 to 0.25 mm. FIGS. 3, 4 and 5 illustrate other operable configurations of zone III.

While the best known form and embodiments of the invention have been illustrated and described, it will be apparent to those skilled in the art that modifications and changes may be made in the apparatus described without deviating from the invention set forth in the following claims.

I claim:

1. Chain saw guide bar with a sprocket wheel at its free end and which wheel supports the saw chain and is rotatably journalled on a hub and is surrounded by side plates, the part of the side plates that surrounds the sprocket wheel being formed by embossing of concentric zones (I, II, III), the embossing depth of which provides a gap between the side plate (4, 5) and the sprocket wheel (1), which gap increases with the radial distance from the center (6) of the sprocket wheel.

2. Chain saw guide bar as defined in claim 1, wherein the gap increases step-by-step.

3. Chain saw guide bar as defined in claim 1, wherein the gap increases continuously.

4. Chain saw guide bar according to claim 1, wherein hub and sprocket wheel have been punched out of the same material in one operation, characterized in that the innermost zone (I) is plane, lies close to the hub and has a diameter less than that of the hub.

5. Chain saw guide bar according to claim 1, in which the second zone extends from the edge of the innermost zone to a diameter exceeding the inner diameter of the sprocket wheel (1).

6. Chain saw guide bar according to claim 5, in which the second zone is plane and embossed in such a way that there exists a narrow gap (7) between the side plate (4, 5) and the sprocket wheel (1).

7. Chain Saw guide bar according to claim 6, characterized in that said narrow gap (7) can serve as a reservoir for a lubricant.

8. Chain Saw guide bar according to claim 5, according to which the peripheral part (8) of the second zone forms a sealing- and guiding surface for the inner part (9) of the sprocket wheel.

9. Chain saw guide bar according to claim 1, wherein the third zone extends from the outer edge of the second zone to the outer contour of the side plates (4,5).

10. Chain saw guide bar according to claim 9, according to which the gap between the side plate and the sprocket wheel within the third zone increases outwards in one or several steps.

* * * * *